US006067674A

United States Patent [19]

Moser

[11] Patent Number: 6,067,674

[45] Date of Patent: May 30, 2000

[54] ENERGY TRANSFERRING TOILET SEAT

[75] Inventor: Scott A. Moser, La Jolla, Calif.

[73] Assignee: Mo-Bility Inc., San Diego, Calif.

[21] Appl. No.: 09/040,933

[22] Filed: Mar. 19, 1998

Related U.S. Application Data

[63] Continuation-in-part of application No. 08/820,986, Mar. 19, 1997, abandoned.

[51] Int. Cl.[7] ..... A47K 13/10

[52] U.S. Cl. ..... 4/667; 4/254

[58] Field of Search ..... 4/254, 667, 578.1, 4/579, 560.1

[56] References Cited

U.S. PATENT DOCUMENTS

| | | | |
|---|---|---|---|
| 2,598,577 | 5/1952 | Mattison | 4/254 X |
| 3,473,174 | 10/1969 | Cool | 4/667 |
| 3,479,087 | 11/1969 | Burke | 4/578.1 X |
| 4,185,335 | 1/1980 | Alvis | 4/667 |
| 4,538,853 | 9/1985 | Levenberg | 297/339 |
| 4,587,678 | 5/1986 | Love et al. | 4/667 |
| 4,690,457 | 9/1987 | Poncy et al. | 297/337 |
| 4,833,736 | 5/1989 | Sadler et al. | 4/667 |
| 4,884,841 | 12/1989 | Holley | 297/331 |
| 4,907,303 | 3/1990 | Baird | 4/667 |
| 4,993,085 | 2/1991 | Gibbons | 4/667 |
| 5,063,617 | 11/1991 | Ward et al. | 4/667 |
| 5,082,327 | 1/1992 | Crisp | 297/313 |
| 5,142,709 | 9/1992 | McGuire | 4/667 |
| 5,189,739 | 3/1993 | Thierry | 4/254 |
| 5,316,370 | 5/1994 | Newman | 297/313 |
| 5,588,162 | 12/1996 | Robinson | 4/667 |
| 5,592,703 | 1/1997 | Jones et al. | 4/667 |
| 5,626,389 | 5/1997 | Logan, Jr. | 297/250.1 |
| 5,661,858 | 9/1997 | House et al. | 4/667 |

*Primary Examiner*—Robert M. Fetsuga
*Attorney, Agent, or Firm*—Aquilino, Welsh & Flaxman

[57] ABSTRACT

A toilet seat provides a lifting operation to assist a user to safely engage and disengage a toilet. A toilet seat is pivotally arranged to swing between two positions, an incline position and a horizontal position. While the seat is in the incline position, a user may approach it from a slightly bent standing position. By pushing against the seat, the user's weight loads an energy storing strut and forces the seat to lower gently into its horizontal position. After which, the user may benefit from energy stored in the strut. The seat applies a pressure which lifts the user from the toilet and into a natural standing position. In some versions, the seat is powered by a compressed gas strut which is loaded by a user's weight when the user engages the device. The loaded strut energizes the pivoting seat to provide a force which operates to remove the user from the toilet. Additionally, the seat may be arranged with armrests so the user's arm strength may be used to aid the transition to and from the toilet.

23 Claims, 8 Drawing Sheets

FIG. 3
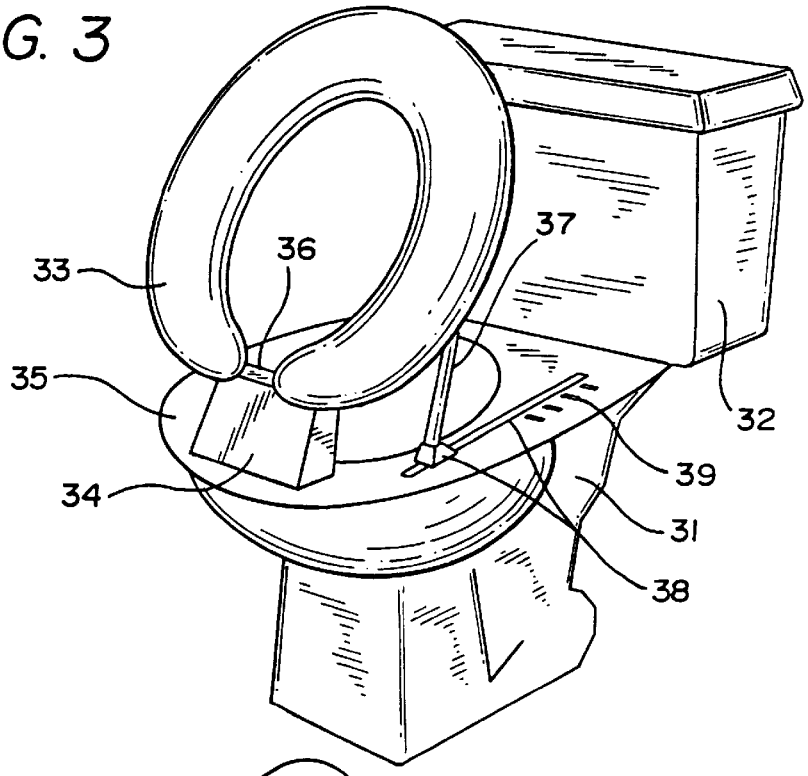
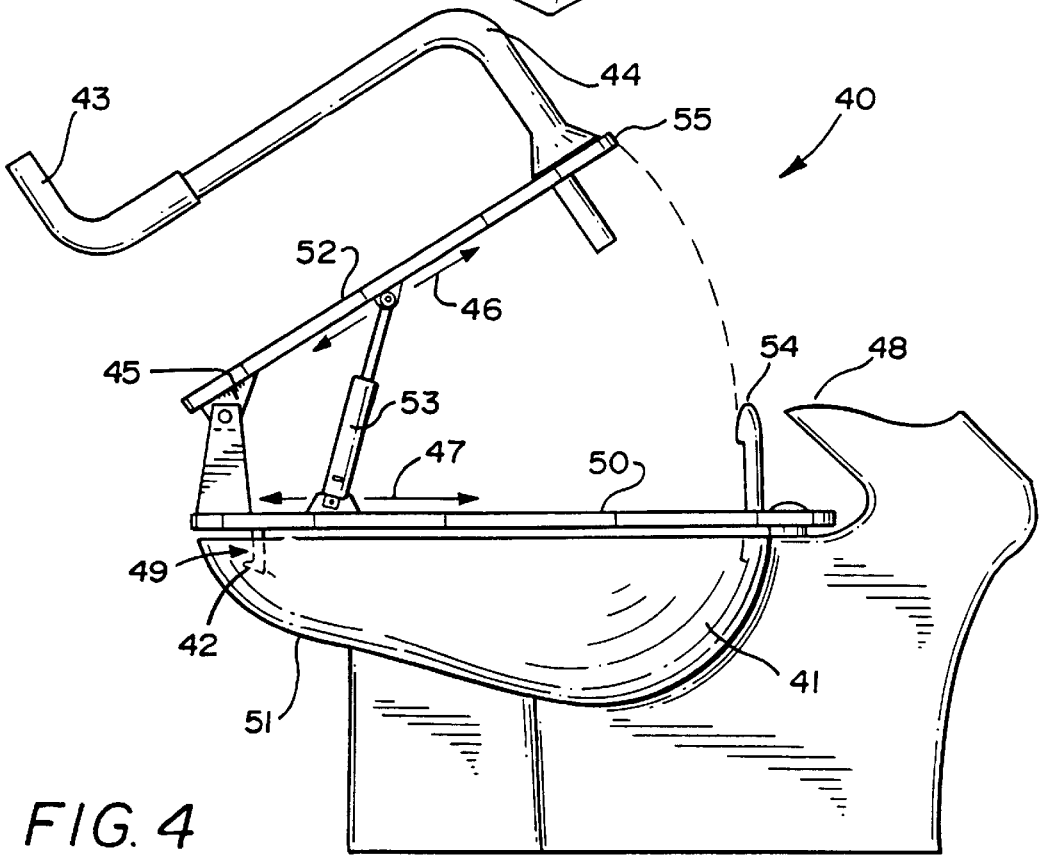
FIG. 4

ENERGY TRANSFERRING TOILET SEAT

CROSS REFERENCE TO RELATED APPLICATIONS

This is a continuation-in-part of U.S. patent application Ser. No. 08/820,986, filed Mar. 19, 1997, entitled "Energy Transferring Toilet Seat", abandoned.

BACKGROUND OF THE INVENTION

1. Field of the Invention

The present invention relates to toilet seats. More particularly, the present invention relates to toilet seats including lowering and lifting mechanisms assisting a user when engaging and disengaging a toilet.

2. Prior Art

Lifting toilet seats have been provided by artisans wishing to address problems some persons may have in using common toilets. A common toilet is designed to accommodate healthy persons in a sitting position. Persons wishing to use a toilet generally start from a standing position and sit thereto on a toilet seat. While most would not pay mind to this relatively common act, many persons are disabled in a manner which prevents them from doing so without great difficulty.

Consequently, inventors have set forth and applied their skills in an attempt to solve this problem. Among those, that can be found is the inventors of U.S. Pat. No. 5,592,703 a powered toilet seat lift. The device employs fluid power cylinders to lift a seat vertically from a toilet bowl. The complex arrangement is not easy to install nor to clean and may be expensive as it requires a great deal of specialized materials and equipment. Alternatively, Hydra-Commode Lift Services Inc. teach a hydraulically activated device to raise a person from a toilet. The device is primarily concerned with lifting large loads and is therefore designed with special features which may address those problems. Again, the device may serve well its main purpose, but it requires a complex machine and installation which might not suit all facilities. The elderly particularly have a difficult time installing such devices and would likely find this machine cumbersome.

In U.S. Pat. No. 5,082,327 a chair having a seat which operates to lift its user therefrom is disclosed. Inventors Ward et al., also disclose a toilet seat which is designed with the intention of aiding one's use of a toilet. U.S. Pat. No. 5,063,617 shows a detailed presentation relating to a tilting seat driven by hydraulic pressure. Finally U.S. Pat. No. 4,993,085 shows another technique for employing fluid power to urge one from a sitting position.

Notwithstanding, applicant has developed novel toilet seats in combination with stored energy devices, particularly to assist persons, especially the infirm, elderly, or otherwise disabled, as they use toilets.

SUMMARY OF THE INVENTION

It is, therefore, and object of the present invention to provide a toilet seat apparatus including a base member adapted for selective attachment to a toilet, a seat pivotally secured to the base member such that the seat may rotate forward, and an energy storing strut including a first end coupled to the base member and a second end coupled to the seat.

It is another object of the present invention to provide a toilet seat wherein the strut includes mechanical means for storing energy. The strut has a relaxed state and a loaded state, and the strut is arranged such that it is in the relaxed state when the seat is in the inclined position and is in the loaded state when the seat is in a horizontal position.

It is also an object of the present invention to provide a toilet seat wherein the strut is adjustably connected between the seat and the base member.

It is another object of the present invention to provide a toilet seat including a holding means for preventing the strut from applying upward force on the seat until holding means is actuated by a release.

It is a further object of the present invention to provide a toilet seat wherein the holding means includes a retractable detent coupled to the base member for selectively engaging the seat and holding the seat in its horizontal position with the strut loaded.

It is also an object of the present invention to provide a toilet seat wherein the retractable detent is actuated by a cable coupled to the base member which permits easy access by a user.

It is another object of the present invention to provide a toilet seat including at least one armrest coupled to the base member, wherein the at least one armrest includes a hand cable coupled to the retractable detent for actuating the retractable detent.

It is a further object of the present invention to provide a toilet seat wherein the hand cable is selectively connected to the retractable detent.

It is another object of the present invention to provide a toilet seat wherein the strut, in a relaxed position, causes the seat to be inclined about 45 degrees relative to the base member.

It is a further object of the present invention to provide a toilet seat including a base member, a seat pivotally secured to the base member, and at least one retractable clothing holder coupled to the base member. The retractable clothing support includes a clip for selective attachment to the clothing of a user, wherein the user may selectively secure the clip to clothing prior to using the toilet such that the clothing is easily retrieved when the user wishes to dress.

It is also an object of the present invention to provide a toilet seat wherein the retractable clothing holder includes a cord having a free end coupled to a clip.

It is another object of the present invention to provide a toilet seat including at least one armrest, wherein the retractable clothing support is coupled to the at least one armrest.

It is a further object of the present invention to provide a toilet seat including a base member adapted for selective attachment to a toilet, a seat pivotally secured to the base member, and at least one armrest pivotally and releasably coupled to the base member.

It is also an object of the present invention to provide a toilet seat wherein the base member includes a support hub having a receiving hole shaped and dimensioned to pivotally and releasably couple the at least one armrest to the base member.

It is another object of the present invention to provide a toilet seat wherein the receiving hole has a notch shaped to receive a projection formed in a first end of the at least one armrest when the at least one armrest is oriented relative to the base member at a preselected orientation, such that the first end of the at least one armrest may be selectively and releasably coupled to the base member.

It is a further object of the present invention to provide a toilet seat wherein the projection of the at least one armrest is aligned with the notch of the support hub when the at least one armrest rotates more than 90 degrees relative to the base member.

BRIEF DESCRIPTION OF THE DRAWINGS

FIG. 3 is a perspective drawing of a toilet with another embodiment of the present toilet seat attached thereto.

FIG. 4 is a partial cross sectional view of a toilet with a further embodiment of the present toilet seat attached thereto.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

For the elderly, infirm, or otherwise disabled persons, simple everyday tasks may become difficult or impossible. To merely lower and raise oneself to and from a toilet, which as a matter of nature is likely to occur several times throughout the course of a day, one might be faced with an uncomfortable challenge. The motions required may cause not only pain and discomfort, but are also accompanied by the possibility of a fall which may cause injury.

Not only is it possible that persons using the toilet may become injured as a result of falling or standing, but others who attempt to provide help may also be subject to undesirable risk. Indeed, persons assisting others in nursing homes and hospitals, among other places, account for a significant number of injuries as their backs tend to be overstrained when lifting a person from a toilet.

Finally, as personal privacy is generally preferred when tending to washroom matters, persons will be greatly relieved to have available to them a device which is easy to operate without the aid of others.

Figure 1:
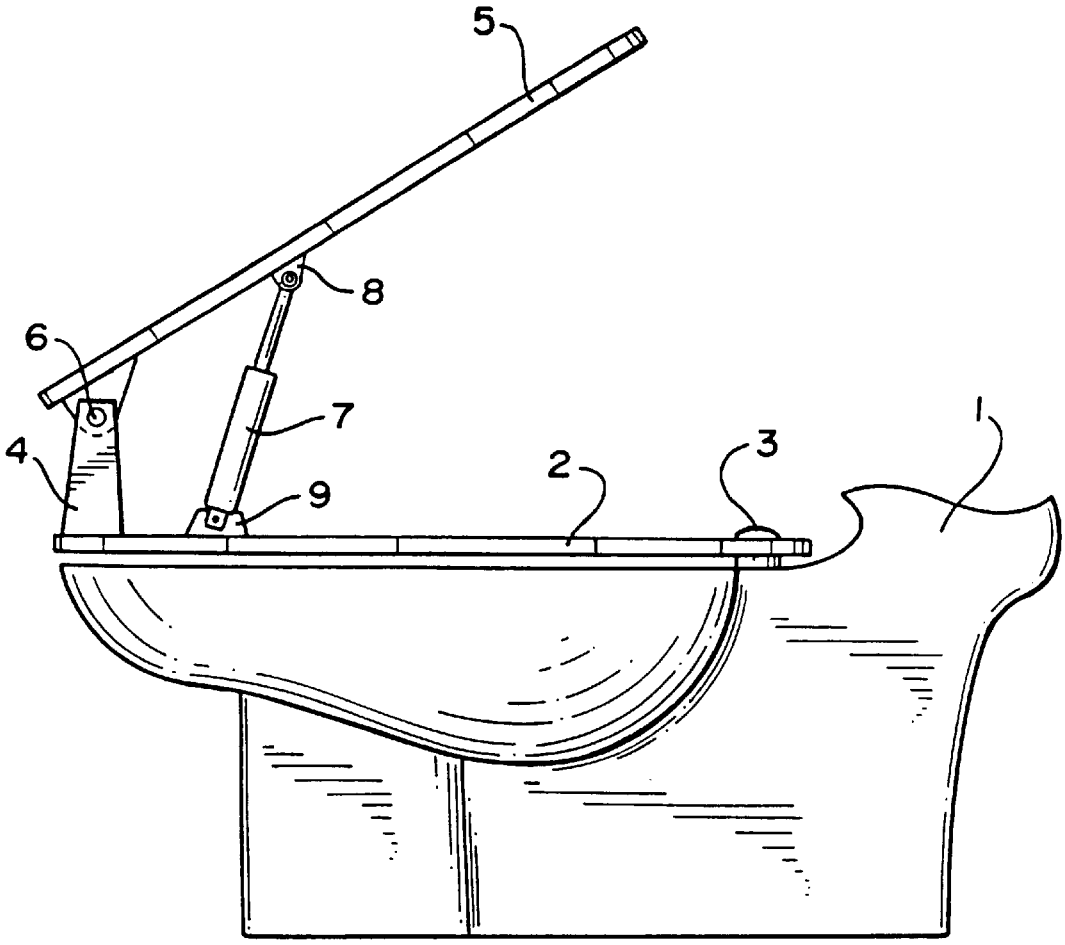
FIG. 1 is a cross sectional view of a toilet with the present toilet seat attached thereto.

Accordingly, a toilet seat which allows one to gently sit on, and raise from, a toilet is herein disclosed. With reference to FIG. 1, the present toilet seat is coupled to a standard toilet 1. Briefly, the present invention uses a stored energy system to lift and lower a individual wishing to use the toilet. Energy from the user's weight being lowered is converted to a potential energy in a mechanical strut. When a user wishes to lift oneself from the toilet, the stored energy is expended in a lifting motion which tends to position the user in a natural standing position. The present invention is highly adjustable for users of various sizes. The present invention is also self contained and does not require an external energy source.

The toilet seat includes a rigid base member 2 having a front and rear portion releasably coupled to the toilet via standard mounting hardware 3. The base member 2 includes a top surface supporting devices having been affixed thereto. A stand-off member 4 having a top portion and a bottom portion extends from the top surface of the base member 2 upward to a hinge 6. A seat 5 is pivotally mounted to the hinge 6 such that the seat 5 may swing about an arc from a horizontal position to an inclined position. The seat 5 includes front and rear portions.

An energy storing support strut 7 is coupled between the seat 5 and the base member 2. The energy storing support strut is preferably a dual dampened strut which includes dual orifices for restricting the flow of gas or fluid during both compression and expansion of the strut, although other struts may be used without departing from the spirit of the present invention. The size of the orifices may be adjusted to control the rate at which the seat rises or is lowered. The first end of the strut 7 is pivotally coupled to the underside 8 of the seat 5 and the second end of the strut 7 is pivotally coupled to the top surface of the base member 2. The energy storing support strut 7 is preferably a compressed gas device, although other energy storing support struts may be employed without departing from the spirit of the present invention. In operation, the strut 7 has a minimally loaded, or relaxed, state and a loaded state. The strut offers resistance to compression when a user sits on the seat 5 and tends to return to its relaxed state when the user lifts from the seat 5. In this way, pressure applied to the seat 5 which tends to force it towards its horizontal position causes the strut 7 to become loaded. Energy is stored in the strut 7 and the strut 7 uses the energy to encourage the seat 5 to return to its inclined position.

Figure 2:
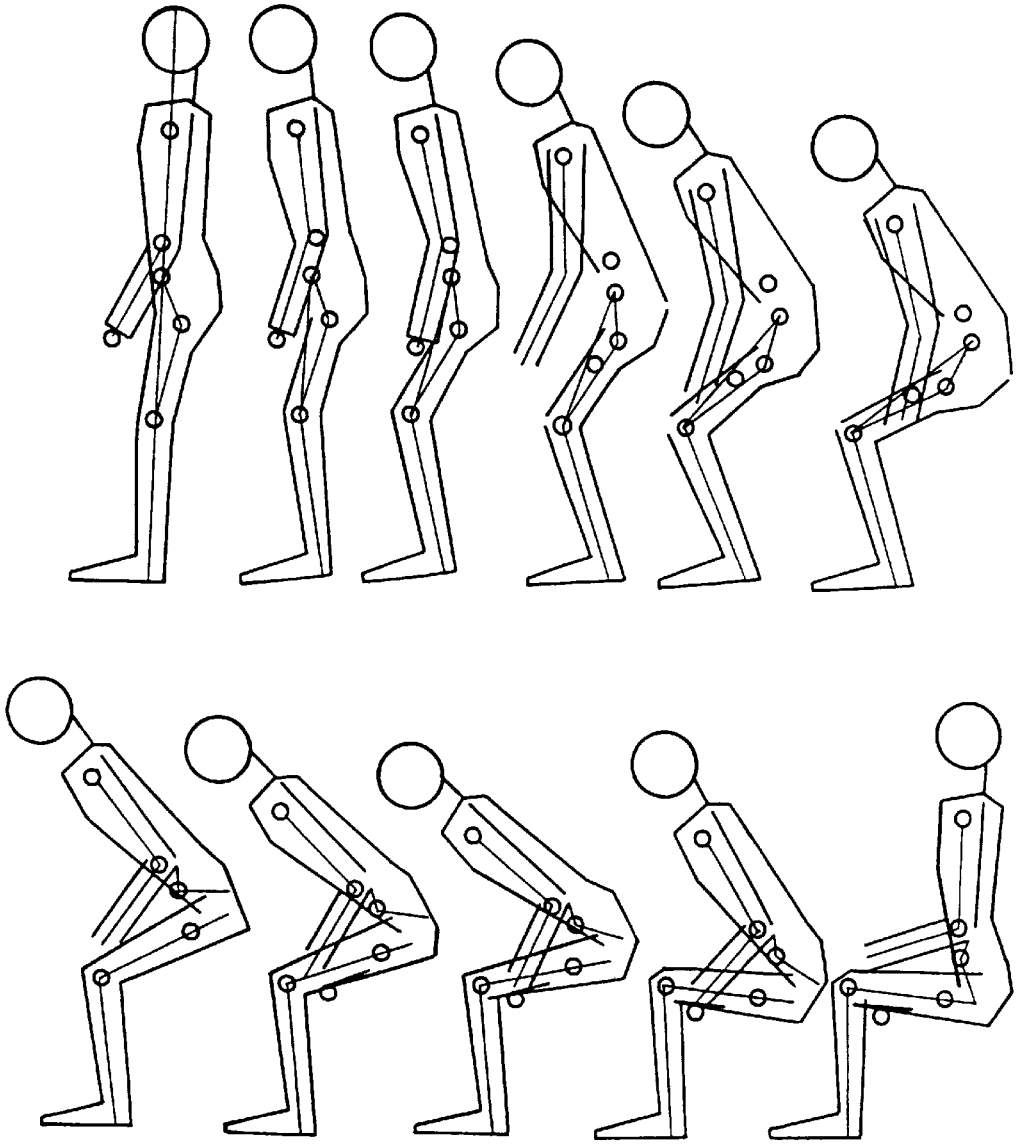
FIG. 2 is a series diagram showing a person in transition from a standing position to a sitting position.

FIG. 2 shows the body positions of a personal in transition from a standing to a sitting position. In the standing position, the forearms and femur are nearly parallel. As one progresses through the transition to the sitting position, the knee forms approximately a 90 degree angle. For most persons, the height of a common toilet seat is lower than the position which would allow the knees to form a 90 degree angle. This is undesirable because from that position, it is particularly difficult to apply the leg muscles to stand up again. It may be preferred that one should start from a position like that of the last of the series of FIG. 2 when setting forth to stand. For this reasons, a toilet seat of the invention may additionally includes a stand-off member which is about between three and six inches.

The mounting hardware used to releasably secure the present toilet seat to a toilet is quite standard. In general, two bolts are used to fasten a toilet seat, and more particularly, the base member 2 at the rear of the toilet. It is an object of the invention to provide a system which is easy to install without the need for complicated hardware and machinery. Accordingly, the present invention is constructed to cooperate with the mounting means commonly found on most toilets. Since the device may be subject to extra torsional forces at its mounting, the hardware may be augmented with special bushings. For example, simple bolts which go through the toilet porcelain may instead be inserted into a sleeve of soft bushing material. When tightened, these bolts would not transmit damaging force to the porcelain.

The base member may be fabricated from a metallic or plastic sheet. In accordance with the preferred embodiment of the present invention, the base member 2 is generally a flat rigid material having a top and bottom surface. The base member is preferably arranged to receive and support thereon the stand-off member 4 at one end thereof. The stand-off member 4 may be welded to the base member 2, or merely formed thereon during the molding process. It is possible to form the base member and stand-off member 4 as an integral unit. The stand-off member 4 is arranged to accommodate a hinge 6 at its top end.

The hinge 6 has two portions which are pivotally related along a pivot axis. A first portion is attached to the top of the stand-off member 4. The second portion is attached to the seat 5, preferably along its underside. The seat may be highly conventional with only minor modifications to support mounting hardware for the hinge and the strut. This hardware may be inexpensive and mechanically simple.

The strut 7 is preferably a cartridge type strut having a sealed volume containing compressed gas. The strut 7 has two ends with mounting hardware so that it may easily be fastened to the seat 5 and the base member 2. The strut stores energy in the form of compressed gas which is released back to the mechanical system on demand. The strut, therefore, has a relaxed state and a loaded state. In its loaded state, the strut stores energy. The ends of the strut are at a predetermined distance when the strut is in a relaxed state. When the ends are forced together along the longitudinal axis of the strut, the strut resists further compression as it becomes loaded.

With reference to FIG. 3, a common toilet 31 incorporating a toilet seat in accordance with the present invention is disclosed. A tank 32 of the toilet 31 and other standard facilities do not interfere with the operation or position of the seat 33. A stand-off member 34 is disposed at the front of the toilet 31 and is mounted to a base member 35. The stand-off member 34 is mounted to the seat 33 at a hinge 36 which is movable about a pivot axis. A strut 37, in a relaxed state, holds the seat 33 in an inclined position. While in its inclined position, the seat 33 is preferably held at about 45 degrees. However, the seat 33 may be arranged to be held at a higher or lower position depending upon personal preferences without departing from the spirit of the present invention.

As with the embodiment described with reference to FIG. 1 above, the strut 37 includes a first end mounted to the underside of the seat 33 and a second end mounted to the top surface of the base member 35. The strut mounting hardware 38 includes a position adjustable means which facilitates custom fit and personal preferences. This strut mounting hardware 38 may be a manual adjustment system facilitated by way of a simple mechanical latch or the strut mounting hardware may be an automatic system. One such automatic system responds to the weight being applied to the seat. A pressure sensitive mechanism rides past variably sized detents along a track. When the applied pressure is no longer strong enough to overcome a detent, the device engages the track in a secure way without further advance along the track. In this way, the strut is self adjustable for different persons who may use the seat. Indicia 39 may include a scheme devised to indicate proper settings for users of a different weight category.

As shown in FIG. 4, the present toilet seat 40 may be modified to include additional features. For example, a common toilet 41 may have a lip 49 around the periphery of the bowl aperture. The base member 50 is accordingly releasably and securely held to the toilet bowl by way of a clip 42 which strongly holds the base member 50 to the front of the toilet bowl 51. Such a clip 42 is integrally formed with the base member 50 and makes for a firm attachment between the base member 50 and the toilet 41.

The toilet seat 40 of the present invention may also include a specialized armrests 43 (one shown) configured to swing with the seat 52. In careful analysis, one might note the natural biomechanics suggest that the armrests 43 may be useful in aiding the transition from seating to standing positions and vice-versa. This is particularly enhanced when the armrests 43 move in conjunction with the plane of the seat 52. The armrests 43 are, therefore, fastened directly to the seat 52 at a support member 44. The entire seat 52 and armrest 43 assembly then move together as one about the pivot axis 45.

The strut 53, attached at a first end to the underside of the seat 52 and attached at a second end to the top surface of the base member 50, may be adjustably mounted at either or both ends. Arrows 56 indicate that the top of the strut may be slidably affixed to the seat. Arrows 47 similarly suggest the strut's bottom end may be adjustably affixed to the base member 50.

Since a loaded strut 53 may operate to prematurely lift the seat 52, for example should one shift weight on the seat by leaning to reach for toilet paper, it is desirable to provide a locking mechanism to hold the seat 52 in its horizontal position until lifting is desired. As such, a small latch 54 is secured to the top surface of the base member 50. The small latch 54 is shaped, dimensioned and positioned to clip onto, and hold, the back side 55 of the seat 52. This prevents the strut 53 from advancing the seat 52 to the incline position before a user desires help in lifting from the toilet 41. In use, when a user wishes to lift from the toilet 41, the user may simply reach back and press the latch 54 to permit the back side 55 of the seat 52 to come free of the small latch 54.

Alternatively, the strut 53 may be designed to safely hold the seat 52 in position until a user desires to be lifted from the toilet 41. In accordance with a preferred embodiment of this modification, the strut 53 will move in a desired direction only after first passing a detent. In this way, the seat stays in the horizontal position until the strut is purposefully pushed past its detent, thus releasing its action in the opposite direction and raising the seat up to its incline position.

An additional embodiment of the present toilet seat is disclosed in FIGS. 5 to 15. As with embodiments of the toilet seat previously described, the toilet seat 100 includes a rigid base member 102 adapted to be releasably secured to the toilet via standard mounting hardware or optional quick release hardware. The base member 102 includes a top surface 104 and a bottom surface 106. The rigid base member 102 is secured to the toilet such that bottom surface 106 faces the toilet and the top surface 104 faces upwardly.

Figure 16:
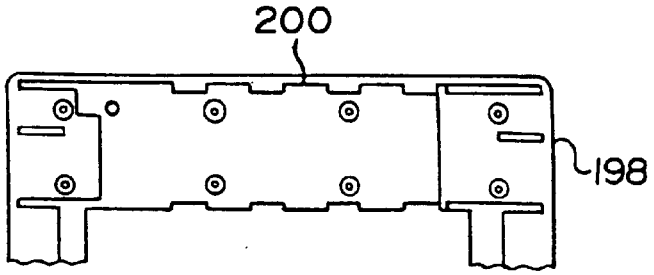
FIG. 16 is a top view of the quick release plate.

With reference to FIG. 16, the base member 102 is provided with a quick release plate 198. The quick release plate 198 is fixedly secured to the toilet and the base member 102 is releasably secured thereto. When an individual wishes to remove the present toilet seat 100, the toilet seat 100 is simply removed by unseating the base plate 102 from the quick release plate 198 by moving it laterally, after the release button 203 (see FIG. 5) on the base plate is actuated. The release button 203 functions to prevent lateral movement between the base plate 102 and the quick release plate 198 by a pin aligned with holes in each plate.

The base plate 102 and the quick release plate 198 are provided with interlocking teeth 200 spaced by grooves 201. In fact, the bottom of the base plate 102 is provided with teeth which mirror the teeth 200 of the quick release plate as shown in FIG. 16 As such, the base plate 102 is coupled to the quick release plate 198 by simply placing the base plate 102 on top of the quick release plate 198 such that the teeth on the base plate engage the grooves on the quick release plate and sliding the base plate 102 laterally to lock the teeth on the base plate 102 under the teeth on the quick release plate 198. When an individual wishes to remove the toilet seat 100, the release button 203 is actuated and then the base plate 102 is simply shifted laterally in the opposite direction to disengage the teeth 200, permitting toilet seat 100 to be lifted and removed.

In the event an individual wishes to replace the present toilet seat 100 with a conventional seat, a mirror image release plate, engageable with the release plate 198, is provided for attachment to the conventional toilet seat brackets. The mirror image release plate would be secured to the toilet seat brackets via suitable fasteners and then the conventional toilet seat may be secured to and removed from the quick release plate 198 in the same manner as the base plate 102.

Figure 17:
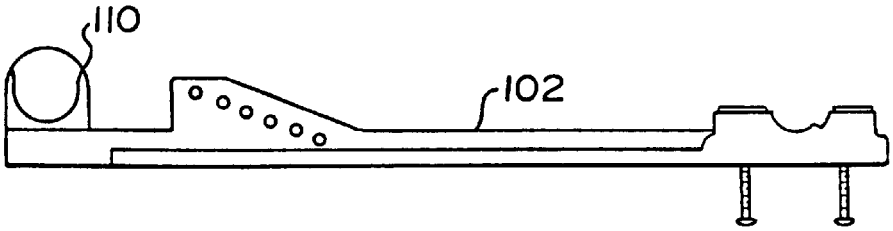
FIG. 17 is a side view of the base member.
Figure 13:
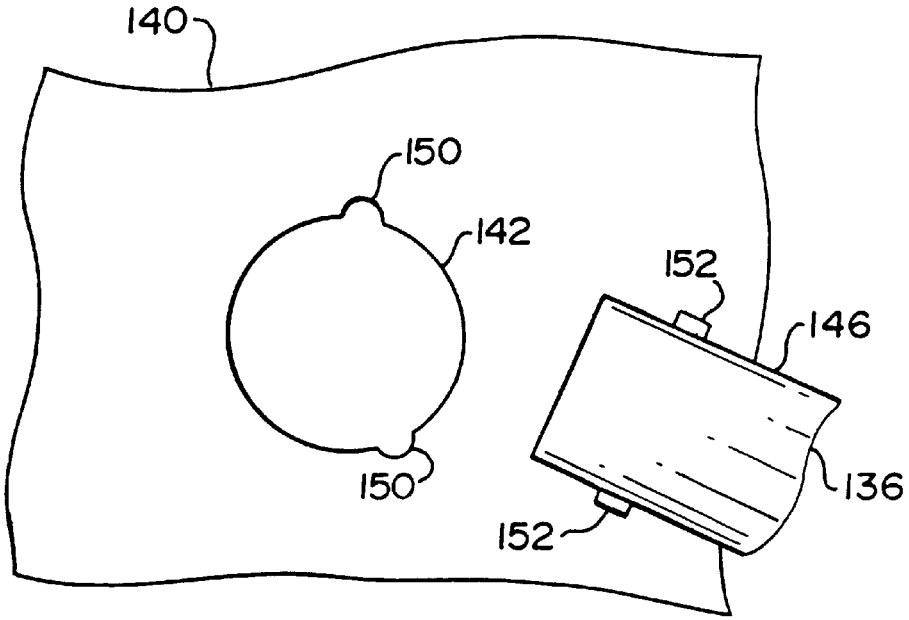
FIG. 13 is a detailed view of the receiving hole and the first end of the first armrest.
Figure 14:
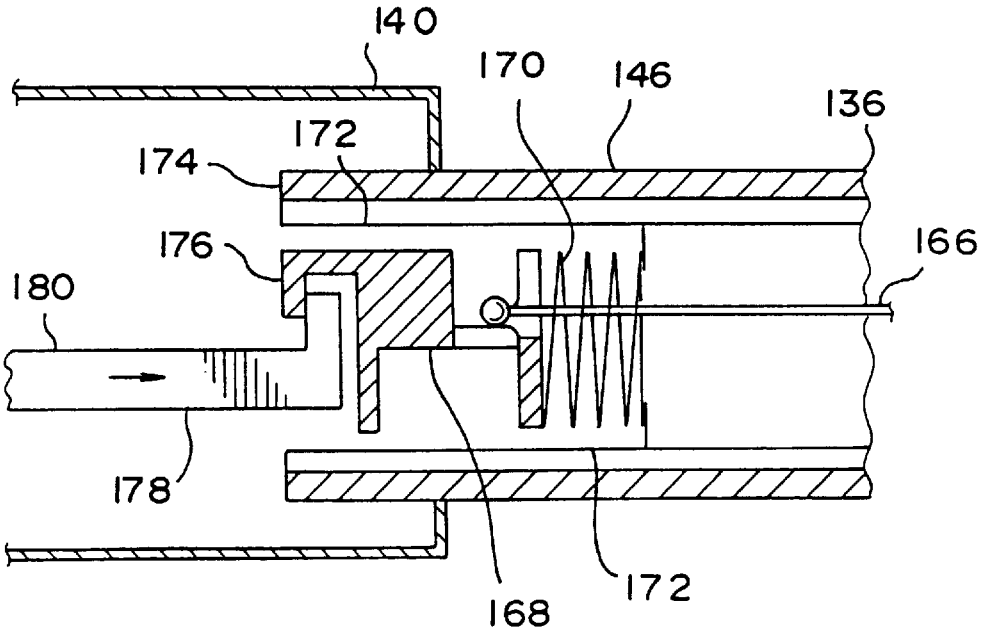
FIG. 14 is a cross sectional view of the cable coupling to the detent slide assembly along the line XIV—XIV of FIG. 7.

The seat 108 is pivotally coupled to the top surface 104 of the base member 102 by a hinge 110 secured between the seat 108 and the base member 102. As with the previous embodiment, the seat 108 is pivotally mounted to the hinge 110 such that the seat 108 may swing about an arc from a horizontal position to an inclined position. As shown in FIG. 17, hinge 110 is provided with an open top edge which permits the seat to be readily released for cleaning when the seat is rotated 90 degrees relative to the base plate.

Figure 5:
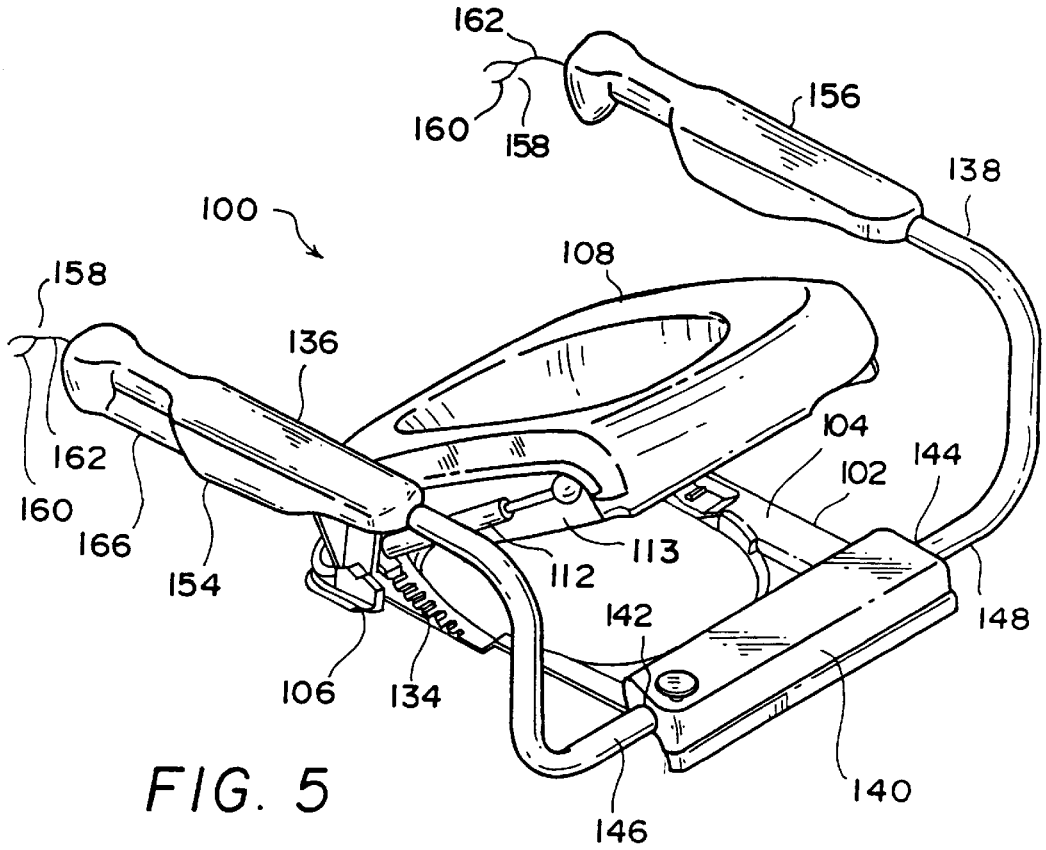
FIG. 5 is a perspective view of an additional toilet seat made in accordance with the present invention, with a partial section showing the strut assembly.
Figure 6:
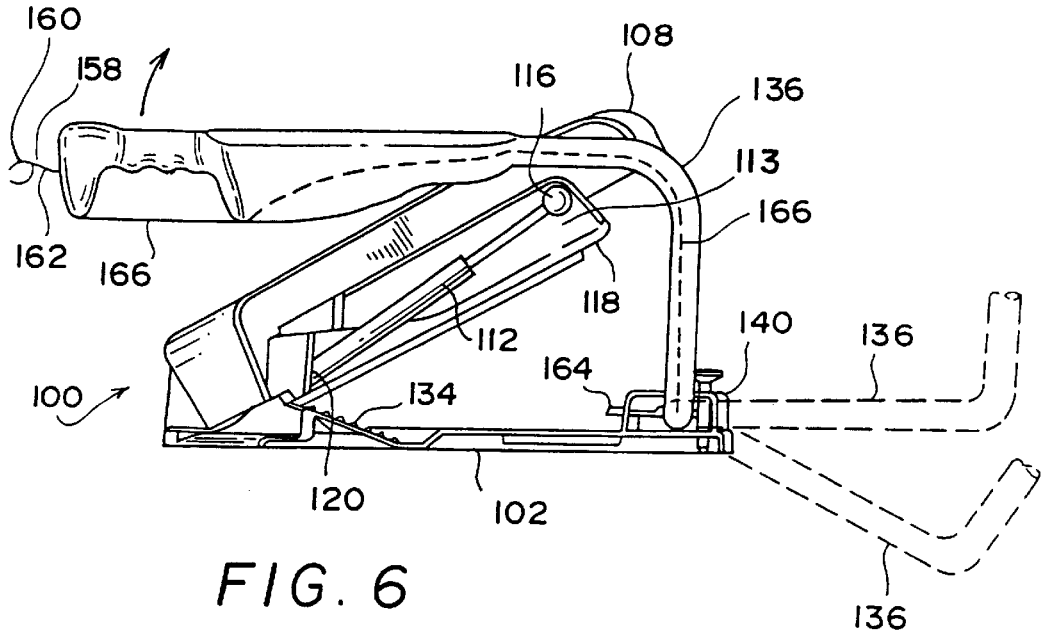
FIG. 6 is a side view of the embodiment disclosed in FIG. 5 with a partial section exposing the strut assembly.
Figure 7:
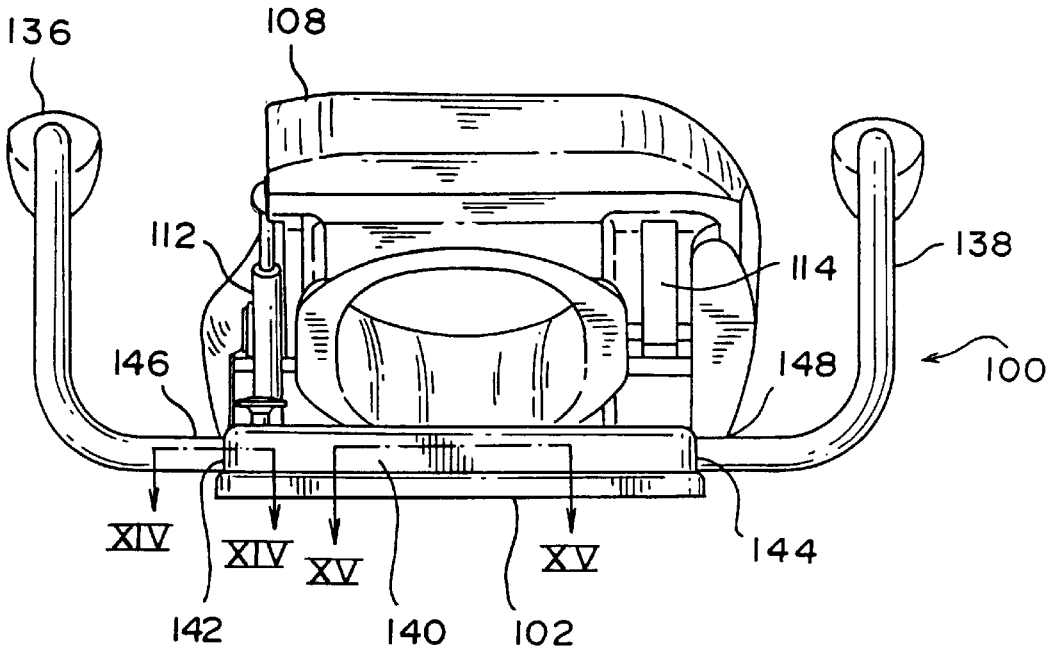
FIG. 7 is a rear view of the embodiment disclosed in FIG. 5.
Figure 8:
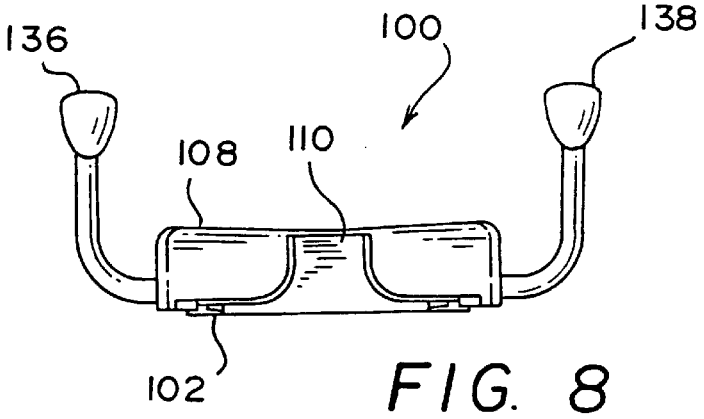
FIG. 8 is a front view of the embodiment disclosed in FIG. 5 with the seat in a horizontal, down position.
Figure 9:
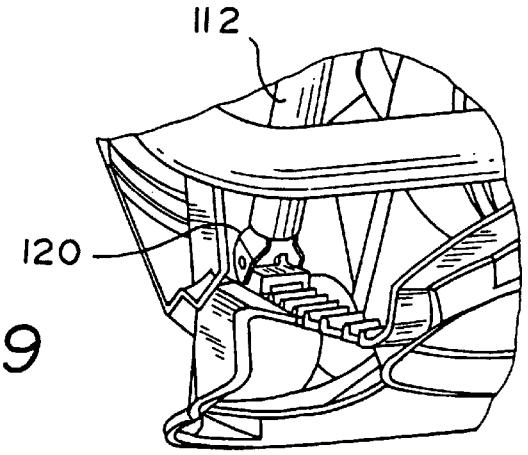
FIG. 9 is a detailed perspective view of the strut adjustment assembly.
Figure 10:
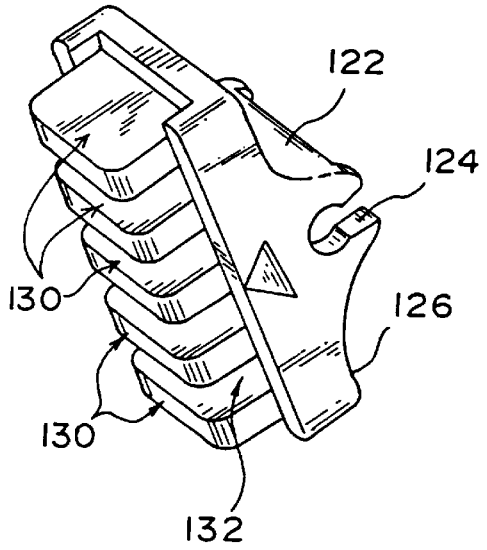
FIGS. 10 and 11 are perspective views if the adjustment block employed in accordance with the embodiment disclosed in FIG. 5.
Figure 11:
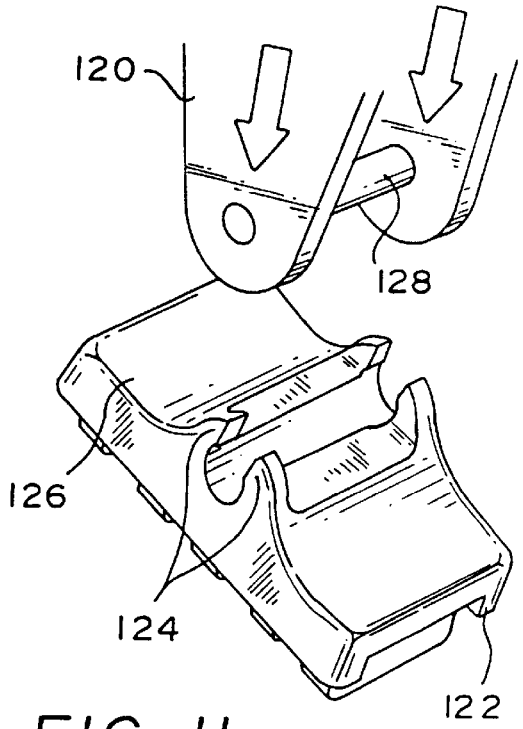
Figure 12:
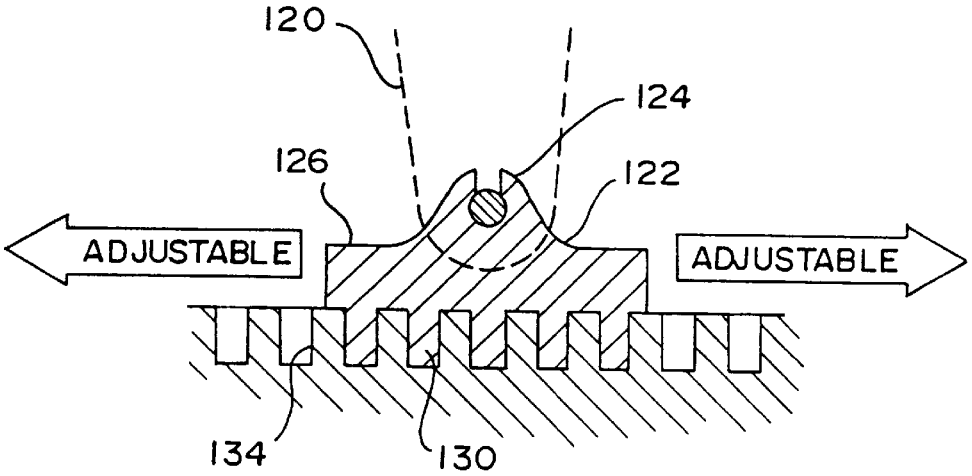
FIG. 12 is a cross sectional view of the adjustment block coupled to the base member.

The toilet seat 100 also includes first and second energy storing support struts 112, 114. The support struts 112, 114 are positioned between the seat 108 and the base member 102, on opposite sides of the toilet seat 100. In fact, as shown in FIGS. 5 and 6 the struts fit into recesses 113 in the underside of toilet seat 100 so as to be enveloped thereby when the seat is lowered. When pressure is applied to the seat 108 which tends to force the seat 108 toward its horizontal position (see FIG. 8) the struts 112, 114 become loaded. The energy is stored in the struts 112, 114 such that the struts may later use the energy to move the seat 108 upwardly (see FIGS. 5, 6, and 7) as discussed above with regard to the embodiments disclosed in FIGS. 1–4.

The support assembly for the struts will now be described with reference to the first strut 112. It should, however, be understood that the strut support assemblies are substantially identical. As shown in FIGS. 5 and 6, the first end 116 of the first strut 112 is pivotally secured to the underside 118 of the seat 108. The second end 120 of the first strut 112 is selectively and pivotally secured to the base member 102. In this way, the force applied by the first strut 112 is selectively adjusted by releasably securing the second end 120 of the first strut 112 at different positions along the base member.

The second end 120 of the first strut 112 is selectively clipped at various locations along the base member 102 to adjust the lifting force between approximately 80 and 400 lbs, although this range may be expanded without departing from the spirit of the present invention. The clipping mechanism is disclosed in detail in FIGS. 9, 10, 11 and 12. The second end 120 of the first strut 112 is releasably clipped to an adjusting block 122. The adjusting block 122 includes a clip opening 124 on its upper surface 126 which is shaped and dimensioned to receive the pivot bar 128 on the second end 120 of the first strut 112. The adjusting block 122 is further provided with a plurality of teeth 130 along its bottom surface 132. The teeth 130 are shaped and dimensioned to engage a series of recesses 134 formed along the base member 100. By moving the adjusting block 122 along the series of recesses 134 formed in the base member 102 a user may adjust the force applied by the first strut 112.

The present toilet seat 100 is provided with first and second armrests 136, 138 positioned on opposite sides of the toilet seat 100. The first and second armrests 136, 138 are rotatably and releasably coupled to a support hub 140 positioned along the rear end 141 of the base member 102. Specifically, the support hub 140 is provided with first and second receiving holes 142, 144 shaped and dimensioned for respectively receiving the first ends 146, 148 of the first and second armrests 136, 138.

The releasable feature of the armrests employed with the present toilet seat will now be described with reference to the first armrest 136 as shown in FIGS. 5, 6, 7, 8 and 13. It should, however, be understood that second armrest 138 is secured to the support hub 140 in the same manner as described below with reference to the first armrest 136. With reference to the first end 146 of the first armrest 136 and the first receiving hole 142 of the support hub 140, the receiving hole 142 is shaped to receive and release the first armrest 136 only when the armrest is rotated approximately 110 degrees from its starting position as shown in FIG. 6.

The receiving hole 142 is accordingly provided with notches 150 oriented to align with projections 152 on the first end 146 of the first armrest 136 only when the armrest is rotated approximately 110 degrees from its starting position. When the notches 150 and the projections 152 are aligned, the first end 146 of the first armrest 136 may be freely inserted into the receiving hole 142 or removed from the receiving hole 142. When the armrest 136 is positioned at other angular orientations, the armrest 136 is securely held in position such that the armrest 136 may freely rotate relative to the support hub 140. In this way, the armrest 136 may be easily removed from the present toilet seat 100 to accommodate the needs of certain individuals and allow for easy storage of the present toilet seat 100.

By permitting removal of the armrest when the armrest is rotated to approximately 110 degrees, the armrest is free to rotate from 0 degree to over 90 degrees without fear that the armrest will become disengaged. In fact, the conventional positioning of the present toilet seat will prevent the armrest from rotating more than approximately 90 degrees, because the armrest will contact a wall before moving to a position where the armrest may be removed from the support hub. With this in mind, the release orientation of the armrest and receiving hole may be varied to accommodate different uses of the present toilet seat without departing from the spirit of the present invention.

The second ends 154, 156 of the first and second armrests 136, 138 are provided with handles that user's may grip as they move onto, and off of, the present toilet seat 100. The second ends of the first and second armrests are also provided with retractable clothing holders 158. Briefly, many elderly individuals find it very difficult to pull their clothing up after they have removed their clothing to use the toilet. If the user allows his or her clothing to fall to the floor while using the toilet, he or she must bend to the floor to pick up the dropped clothing. Many elderly people find this very difficult and attempt to hold onto their clothing while they use the toilet. This is also very difficult, and makes the process of using the toilet even more difficult for elderly users.

With this in mind, the present toilet seat 100 is provided with retractable clothing holders 158 secured to the second ends 154, 156 of the first and second armrests 136, 138. Each holder 158 includes a clip 160 secured to the free end of a cord 162. The cord 162 is stored in the second ends 154, 156 of the first and second armrests 136, 138, and may be retracted when a user wishes to secure the clip 160 to his or her clothing. The cord 162 is spring biased to return to its retracted positioned within the second ends 154, 156 of the armrests 136, 138.

In use, an individual wishing to use the toilet simply secures the holders 158 to his or her clothing by securing the clips 160 to the clothing prior to using the toilet. The clips 160 are preferably 3 lb. tear away clips such that they will simply unclip if a user should walk away from the toilet without remembering to unclip his or her clothing. Once the holders 158 are properly secured to the user's clothing, the user may employ the toilet in the manner discussed above with regard to the embodiments disclosed in FIGS. 1–4. When the user is finished and is in a standing position, he or she may pull on the cords 162 to pull the clothing up to a convenient position for dressing.

The present toilet seat 100 is also provided with a convenient release mechanism for holding the seat in its horizontal position, with the strut loaded. Specifically, and with reference to FIG. 6, the support hub 140 is provided with a retractable detent 164 that selectively engages the seat 108 to hold it in its horizontal, loaded position. The detent 164 is spring biased to a projected position and is retracted by actuating hand cables 166 provided adjacent the second ends 154, 156 of the first and second armrests 136, 138. The hand cables 166 are coupled to the detent 164 via the coupling assembly disclosed in FIGS. 6, 14 and 15. The coupling assembly will be described below with reference to the first armrest 136, although it should be understood that the coupling assembly is substantially identical for the second armrest 138. Specifically, the hand cable 166 extends into the body of the first armrest 136 to the first end 146 of the first armrest 136. The cable 166 is connected to a spring loaded connecting member 168 located at the first end 146 of the first armrest 136.

The connecting member 168 is mounted at the first end 146 of the first armrest 136 such that the cable 166 pulls the connecting member 168 into the body of the armrest when a user compresses the exposed hand cable 166 and the spring 170 forces the connecting member 168 toward the first end 146 of the armrest 136 when the hand cable 166 is released. For reasons that will become apparent from the following disclosure, the connecting member 168 is prevented from rotating within the first end 146 of the first armrest 136 by slidably securing the connecting member 168 within grooves 172 formed in the first end 146 of the first armrest 136. The grooves 172 permit the connecting member 168 to longitudinally slide within the second end 146 of the first armrest 136, but prevent the connecting member 168 from rotating therein.

When the cable 166 is released and the connecting member 168 is moved to the outer edge 174 of the second end 146 of the first armrest 136, a hooked projection 176 of the connecting member 168 extends slightly beyond the edge 174 of the first end 146 of the first armrest 136 for attachment to the detent slide assembly. Specifically, and with reference to FIG. 14, the hooked projection 176 is selectively coupled to the first end 178 of the first latch arm 180 of the detent slide assembly. Once coupled to the first end 178 of the first latch arm 180, movement of the connecting member 168 caused by gripping the hand cable 166 pulls the first latch arm 180 toward the first end 146 of the first armrest 136 to force the detent 164 to a retracted position.

Figure 15:
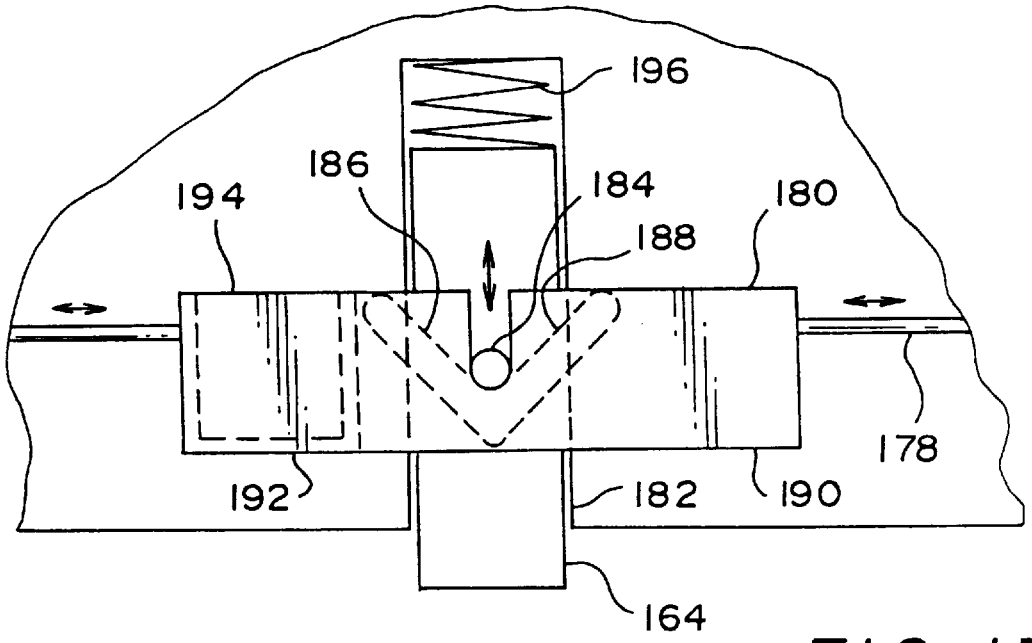
FIG. 15 is a cross sectional view of the detent slide assembly along the line XV—XV of FIG. 8.

The detent slide assembly is disclosed in FIG. 15, and includes a detent 164 mounted in a track 182 for controlled movement. The detent 164 includes an upwardly extending camming pin 184 which engages the camming surfaces 186, 188 formed at the second ends 190, 192 of the first and second latch arms 180, 194. In use, as either the first or second latch arm is drawn away from the detent 164 by compressing the hand cable 166, the camming surfaces 186, 188 formed on the second ends 190, 192 of the first and second latch arms 180, 194 act upon the camming pin 184 to force the detent to a retracted position. Once the force applied by the hand cable 166 is released, the spring 196 biases the detent 164 back to its projected position. In this way, the detent 164 is used to capture or release the seat 108 as is desired by the user of the present toilet.

In accordance with the prior disclosure that the armrests are releasably and pivotally coupled to the support hub, the first connecting member 168, and particularly, the hooked projection 176, is releasably coupled to the first end 178 of the first latch arm 180. Specifically, the hooked projection 176 is shaped and dimensioned such that it disengages from the first end 178 of the first latch arm 180 when the first armrest 136 is rotated for release from the support hub 140. Similarly, the hooked projection 176 engages the first end 178 of the first latch arm 180 when the first arm rest 136 is rotated to its use position in which the handles are substantially parallel to the base member 102. This engagement structure is achieved by shaping the hooked projection 176 and the first end 178 of the first latch arm 180 such that they do not engaged at a first angular orientation, but do engage at a second angular orientation. In this way, the armrests are easily removable, without disrupting the release mechanism provided by the detent and its associated structure.

Although the present invention has been described in considerable detail with clear and concise language and with reference to certain preferred versions thereof including the best mode anticipated by the inventor, other versions are possible. Therefore, the spirit and scope of the appended claims should not be limited by the description of the preferred versions contained therein.

What is claimed is:

1. A toilet seat apparatus comprising:

a base member adapted for selective attachment to a toilet;

a seat pivotally secured to the base member;

at least one retractable clothing holder coupled to the base member, the retractable clothing support including a clip for selective attachment to the clothing of a user, wherein the user may selectively secure the clip to clothing prior to using the toilet such that the clothing is easily retrieved when the user wishes to dress.

2. The toilet seat according to claim 1, wherein the retractable clothing holder includes a cord having a free end coupled to clip.

3. The toilet seat according to claim 1, further including at least one armrest, and wherein the retractable clothing holder is coupled to the at least one armrest.

4. A toilet seat apparatus comprising:

a base member adapted for selective attachment to a toilet;

a seat pivotally secured to the base member;

at least one armrest pivotally and releasably coupled to the base member so as to be easily removable from the base member and seat;

wherein the base member includes a support hub having a receiving hole shaped and dimensioned to pivotally and releasably couple the at least one armrest to the base member; and wherein the receiving hole has a notch shaped to receive a projection formed in a first end of the at least one armrest when the at least one armrest is oriented relative to the base member at a preselected orientation, such that the first end of the at least one armrest may be selectively and releasably coupled to the base member.

5. The toilet seat according to claim 4, wherein the projection of the at least one armrest is aligned with the notch of the support hub when the at least one armrest rotates more than 90 degrees relative to the base member.

6. The toilet seat according to claim 4, further including a second armrest.

7. The toilet seat according to claim 4, further including a quick release plate for releasably securing the base member to a toilet.

8. The toilet seat according to claim 7, wherein the quick release plate releasably engages the base member to permit selective attachment of the base member to the toilet.

9. A toilet seat assist apparatus comprising:

a base member with a substantially planar upper surface having a front and rear portions wherein the rear portion includes means for mounting the base to and above the bowl of a toilet;

a pivotal toilet seat having an upper substantially planar user engaging surface with front and rear portions;

said front portion of the toilet seat connected to said front portion of the base member via a pivot means above the plane of the upper surface of said base member; and an energy storing strut having a first end connected approximate the front portion of the base member and a second opposite end connected approximate the rear portion of said toilet seat such that when the seat is in a substantially horizontal position, substantially all of the strut is located between the base member and toilet seat.

10. A toilet seat assist apparatus of claim 9, wherein the pivot means is in the form of a hinge with an open top edge which permits the seat to be readily released from the hinge for cleaning.

11. A toilet seat assist apparatus of claim 9, wherein said strut having a relaxed state and a loaded state, said strut being arranged such that it is in the relaxed state when the seat is in said incline position and is in the loaded state when said seat is in said horizontal position.

12. A toilet seat assist apparatus of claim 9, wherein said strut is a compressed gas type strut.

13. A toilet seat assist apparatus of claim 9, wherein said strut is adjustably connected to said front portion of the base member at incremental positions increasing in height.

14. A toilet seat assist apparatus of claim 9, wherein the means for mounting the base member to the toilet bowl includes a quick release plate, thus allowing the base member to be easily removed.

15. A toilet seat assist apparatus of claim 9, further including a holding means having a release which operates to prevent said energy storing strut from applying upward force on said seat until the holding means is triggered by the release.

16. A toilet seat assist apparatus of claim 9, further including an armrest affixed to said seat such that the armrest moves in a motion together with the seat.

17. A toilet seat assist apparatus of claim 9, further including an armrest which is pivotally and removably connected to the base member.

18. A toilet seat assist apparatus of claim 9, wherein the toilet seat envelops the strut when the toilet seat is in the substantially horizontal position.

19. The toilet seat according to claim 15, wherein the holding means includes a retractable detent coupled to the base member for selectively engaging the seat and holding the seat in its horizontal position with the strut loaded.

20. The toilet seat according to claim 19, wherein the retractable detent is actuated by a cable coupled to the base member for easy access by a user.

21. The toilet seat according to claim 20, further including at least one armrest coupled to the base member, wherein the at least one armrest includes a hand cable coupled to the retractable detent for actuating the retractable detent.

22. The toilet seat according to claim 21, wherein the hand cable is selectively connected to the retractable detent.

23. A toilet seat according to claim 9, wherein the seat is releasably secured to the base member.

* * * * *